US005695007A

United States Patent [19]

Fauconnier et al.

[11] Patent Number: 5,695,007

[45] Date of Patent: Dec. 9, 1997

[54] HEAT EXCHANGER DEVICE AND METHOD FOR COOLING THE INNER CHAMBER THEREOF

[75] Inventors: Jean-Claude Fauconnier, Paris; Roland Jean-Marie Guidat, Nancy, both of France

[73] Assignees: Faudat Concept, Paris; Ziemann-Secathen S.A., Sarre-Union, both of France

[21] Appl. No.: 522,348

[22] PCT Filed: Mar. 14, 1994

[86] PCT No.: PCT/FR94/00273

§ 371 Date: Sep. 14, 1995

§ 102(e) Date: Sep. 14, 1995

[87] PCT Pub. No.: WO94/21979

PCT Pub. Date: Sep. 29, 1994

[30] Foreign Application Priority Data

Mar. 17, 1993 [FR] France ..... 93 03061

[51] Int. Cl.[6] ..... F28F 9/00

[52] U.S. Cl. ..... 165/128; 165/134.1; 165/135; 165/157; 165/905

[58] Field of Search ..... 165/134.1, 135, 165/157, 166, 905, 128

[56] References Cited

U.S. PATENT DOCUMENTS

| | | | |
|---|---|---|---|
| 2,617,634 | 11/1952 | Jendrassik | 165/166 |
| 4,026,675 | 5/1977 | Marsch | 165/157 X |

FOREIGN PATENT DOCUMENTS

| | | | |
|---|---|---|---|
| 984248 | 7/1951 | France . | |
| 1092115 | 4/1955 | France . | |
| 1161500 | 9/1958 | France . | |
| 2 417 738 | 9/1979 | France . | |
| 1 931 222 | 12/1970 | Germany . | |
| 57-196094 | 12/1982 | Japan . | |
| 60-200090 | 10/1985 | Japan . | |
| 1145232 | 3/1985 | U.S.S.R. | 165/157 |
| 1 411 472 | 10/1975 | United Kingdom . | |
| WO90/09555 | 8/1990 | WIPO . | |

*Primary Examiner*—Allen J. Flanigan
*Attorney, Agent, or Firm*—Young & Thompson

[57] ABSTRACT

A device including a side wall (3) and bottom walls (4, 5) together forming a metal vessel (2) containing a core (7) for exchanging heat between two fluids, i.e. preferably counter-flowing heating and heated fluids. The core is arranged vertically within the chamber and radiates heat towards the inner surface of the side wall through an intermediate space (24) provided between said wall and the core and filled with a fluid which is the same as or different from one of the fluids flowing therethrough. The chamber is cooled both by exposing the side wall (3) to the atmosphere and by using a thermosiphon effect to cause the fluid in the intermediate space (24) to flow through a closed circuit (30) including said intermediate space and at least one pipe (31) located outside the chamber and connected thereto at two vertically spaced points. The device may be used in oil industry exchangers.

24 Claims, 3 Drawing Sheets

HEAT EXCHANGER DEVICE AND METHOD FOR COOLING THE INNER CHAMBER THEREOF

FIELD OF THE INVENTION

This invention relates to heat exchange means, specifically a heat exchanger, and a method for cooling the enclosure of such means. By "heat exchange means" is meant heat exchangers, but also other devices such as the furnaces used in the oil refining industry, boilers, reactors, etc.

BACKGROUND OF THE INVENTION

From Patents FR-A-883006, FR-A-2 131 791, FR-A-2 471 569 and GB-A-527 585, it is known about exchangers consisting of a lateral wall such as a formed sheet metal shell which surrounds a bundle designed to allow the separate and in particular counter-current circulation of two fluids, a heating fluid and a heated fluid respectively, this bundle being preferably but not exclusively constructed from a set of braced parallel plates so as to bound adjacent spaces traversed by these fluids.

The bundle formed by the stack of superimposed parallel plates in which the plates are separated from each other by appropriate spacers or struts provides a passage in two opposite directions for the two fluids which exchange heat between them through the walls of these plates. The channels formed between the plates communicate with headspaces located at the opposite ends of the bundle. These headspaces provide an inlet and/or outlet for the heating fluid and the heated fluid and communicate with pipes for the delivery or discharge of these fluids. The plates are welded along their sides and joined to the headspaces which extend perpendicular to the plane of the plates, depending on the height of the stack of the latter, so as to provide a seal for the circulation channels provided between them. Conventionally the bundle of parallel plates with its terminal headspaces is housed within a sealed enclosure constructed of thick metal sheets which have been suitably shaped and comprise a lateral wall which encloses the bundle leaving a suitable space free between its inner surface and the sides of the stack of plates. Preferably but not exclusively, the exchanger may have any orientation, the lateral wall may be a shell having a general cylindrical profile with a vertical axis extending parallel to the long sides of the plates of the bundle which are also located in vertical planes within the shell, the headspaces being mounted at each end of the long dimension of the bundle. The inlet and outlet pipes for the two fluids are also vertical and pass through the ends respectively, which in this case may be hemispherical or even elliptical, and which close off the top and bottom of the cylindrical shell.

In addition to this, it is known that in such structures communication can be provided between one of the conduits through which one of the two fluids passes and the interior of the sealed enclosure in such a way that the internal space of the latter between the wall and the bundle is filled with the corresponding fluid and is thus at a pressure equal to the pressure of the latter. Preferably the pressure thus created within the enclosure is selected to be equal to that of the fluid which is itself at the highest pressure, normally the fluid which is to be heated, as it enters the plate bundle, so that the latter is held compressed by the pressure difference between the two fluids. This ensures mechanical cohesion of the bundle and avoids thermal short circuits. If desired the shell may be pressurised by means of another fluid, other than the one which enters the bundle, to recover the heat exchanged with the heating fluid.

The sealed enclosure formed in this way has several functions under these conditions, firstly maintaining pressure with respect to the outside with regard to the fluids which pass through the spaces bounded between the parallel plates, one of which fills the free space between the shell and the plate bundle, secondly compressing the bundle as a result of the pressure difference between the regions through which one or other of the fluids respectively flow, and finally providing safe confinement in the event of leakage of one of the fluids passing through it outside the bundle as a result of e.g. a defect in any of the welds which assemble the plates together. This seal is in fact strictly essential if at least one of the fluids and in particular the fluid within the above-mentioned free space contains a toxic or flammable gas, particularly at the temperature to which it is raised through the functioning of the exchanger.

In order to improve the thermal efficiency of the exchanger efforts are of course made to minimise thermal leaks, in particular the amounts of heat given up by the enclosure to the external environment. Thus the enclosure is thermally insulated externally in such a way as to limit the dissipation of heat originating essentially in the exchanger bundle to the exterior by radiation in the space located between the bundle and the lateral wall of the enclosure, or by convection, or even by conduction in the area where the fluid delivery or discharge pipes pass through the lateral wall or the ends of the enclosure.

Now in such a thermally insulated enclosure, which exchanges virtually no heat with the exterior, the temperature of the lateral wall of the enclosure increases progressively from bottom to top as a result of the temperature gradients set up in the vertical plate bundle, particularly between the bottom thereof which generally incorporates the headspace for the discharge of heating fluid and the inlet headspace for the heated fluid, both at a relatively low temperature, and the upper part which comprises the inlet headspace for the heating fluid and the outlet headspace for the heated fluid, at a very substantially higher temperature. The temperature at the base of the enclosure may be of the order of e.g. 100 C, and reach e.g. 450 C at the top if the heating fluid enters the bundle at around 500 C, the heated fluid leaving at almost 480 C.

Under these conditions the cold end of the enclosure and the lower part of the side wall may be constructed using ordinary carbon steel sheets of moderate thickness up to a height where the temperature of the steel does not exceed an average of 270 C in normal operation. However the remaining upper part of the lateral wall and the hot upper end have to be constructed from a steel of a different nature which is capable of withstanding appreciably higher temperatures, e.g. a chromium-molybdenum steel, which will also be thicker. Now this material is very much more expensive and more difficult to use, and this has an appreciable effect on the overall cost price of the exchanger.

SUMMARY OF THE INVENTION

The purpose of the invention is to overcome these disadvantages and in particular to achieve a significant reduction in the cost of heat exchange means of the type envisaged by the invention.

The invention is based on the finding that it is possible to keep at least certain intermediate regions up the lateral wall at relatively moderate temperatures, thus making it possible to use an economical material, without a significant reduction in the efficiency of the exchanger.

For example a welded plate exchanger bundle radiates relatively little heat because the outside surface area of the bundle will only be a few tens of $m^2$ in the case of a bundle whose internal heat exchange surface area amounts to 4000 to 6000 $m^2$ or more.

Thus the heat exchange means comprising a heat exchange bundle which provides separate paths in opposite directions for two exchange fluids and an enclosure which contains the bundle whose inside face is exposed to thermal radiation originating from the bundle through an intermediate space located between the inner surface of the enclosure and the bundle, the enclosure comprising a lateral wall closed off by a hot end at the end at which heating fluid enters and heated fluid departs and a cold end opposite the hot end, is characterised in that the enclosure is constructed in two parts, a cold part which includes the cold end and at least the major part of the lateral wall, and a hot part which includes the hot end and is constructed of a material having a better resistance to heat than the cold part, and in that the exchanger comprises means to remove heat from the enclosure at least in a region of the cold part of the enclosure which is adjacent to the hot part.

This invention makes it possible to bring about a significant reduction in the temperature reached by the lateral wall when the exchanger is in operation and as a consequence to reduce the thickness of the wall and increase the height of the part of this wall which can be constructed of conventional carbon steel. The invention also makes it possible to ensure that this lower temperature does not measurably affect the thermal performance of the exchanger, particularly on account of the very small amount of heat which is removed.

A particular result of the invention is that it appreciably reduces the cost price of the enclosure without adversely affecting its ability to perform its function in respect of the operational safety of the exchanger, maintaining it under pressure and maintaining a seal, in a reliable and effective way, even at temperatures in the plate bundle at which the use of a lateral wall of conventional steel is normally prohibited.

The invention also relates to the means necessary for implementing the method and relates more particularly to heat exchangers incorporating such means. It likewise but more generally relates to all heat exchange equipment using this method, of the type including e.g. furnaces, boilers, or industrial reactors.

Preferably the means for removing heat comprise direct exposure to the external environment of the outer surface of the enclosure in the said region adjacent to the hot part.

When the enclosure encloses a fluid in the intermediate space located between the inner space of the enclosure and the bundle, the means for removing heat may also complementarily or as a variant comprise means for circulating the fluid in the intermediate space in a closed circuit comprising the intermediate space and at least one conduit which exchanges heat with the outside environment and is connected two separate points of the enclosure located on either side of the said adjacent region.

Preferably the fluid present in the intermediate space is circulated by a natural thermal syphoning effect by placing the two aforementioned separate points at two different levels up the enclosure. The fluid present in the intermediate space between the bundle and the inner face of the lateral wall, which is heated mainly by convection and to a lesser extent by radiation from the plate bundle, then cools in the conduit outside the enclosure, which is located in the atmosphere and is at the surrounding ambient temperature. This results in movement of this fluid and its continuous circulation in the closed circuit thereby formed as a result of the change in the density of the fluid in relation to temperature, in the intermediate space and the outer conduit respectively. This circulation then makes it possible to exchange heat taken from the enclosure and carried by the fluid with the outside atmosphere in which the conduit is located, the loss of head produced during this circulation being balanced by the aforesaid change in density.

As appropriate, the fluid circulating in the closed circuit is identical to or different from one of the heating or heated fluids passing through the bundle, and is preferably at a pressure equal to that of the fluid at the higher pressure.

If applicable, where the heated fluid is a two-phase mixture, in particular a mixture of a gas and a liquid, the fluid circulating in the closed circuit comprises the mixture itself or gas separated from the said mixture.

In accordance with a number of variant embodiments, one of the ends of the outer conduit is connected to the upper part of the lateral wall of the enclosure, or an end, e.g. a hemispherical or elliptical end closing off this lateral wall, the other end being connected to the lower part of the said lateral wall or to an intermediate region thereof.

In a particular embodiment of the means in question, in which the lateral wall of the enclosure extends e.g. with its axis vertical, the closed circuit comprises a plurality of external conduits mounted in parallel on the enclosure. Preferably the circuit comprises a conduit for discharge of the fluid from the enclosure and a conduit for return of the fluid into the enclosure, these two conduits extending horizontally, parallel to each other, and being connected by separate pipes which are placed vertically, through which the fluid passes downwards outside the enclosure.

Advantageously the wall of the enclosure incorporates temperature sensors carefully distributed along its height whose readings can be used in order to adjust, manually or through the intermediary of an electronic control device, the opening or closure setting of at least one valve mounted on the outer conduit to adjust the flow of fluid circulating in the closed circuit. Where the enclosure comprises a plurality of external conduits mounted in parallel, all or some of these may incorporate valves subject to temperature measurements made by sensors located on the lateral wall.

In accordance with a second object of the invention the method for cooling a lateral wall of a shaped metal enclosure, a wall which is closed off at each end by an end and which contains a bundle for exchange between two fluids, a heating fluid and a heated fluid respectively, which pass through the bundle preferably by counter-current means, the bundle radiating heat towards the inside surface of the lateral wall in an intermediate space provided between the latter and the bundle and filled with a fluid which is identical to or different from one of the two fluids passing through the bundle, is characterised by the stage comprising circulating the fluid present in the intermediate space through an enclosed circuit which comprises the said intermediate space and at least one conduit outside the space which is connected to two separate points thereof.

Other features of the method and the means according to this invention will appear from the following description of a number of non-restricted embodiments provided by way of illustration with reference to the appended drawings in which:

DESCRIPTION OF THE PREFERRED EMBODIMENTS

Figure 1:
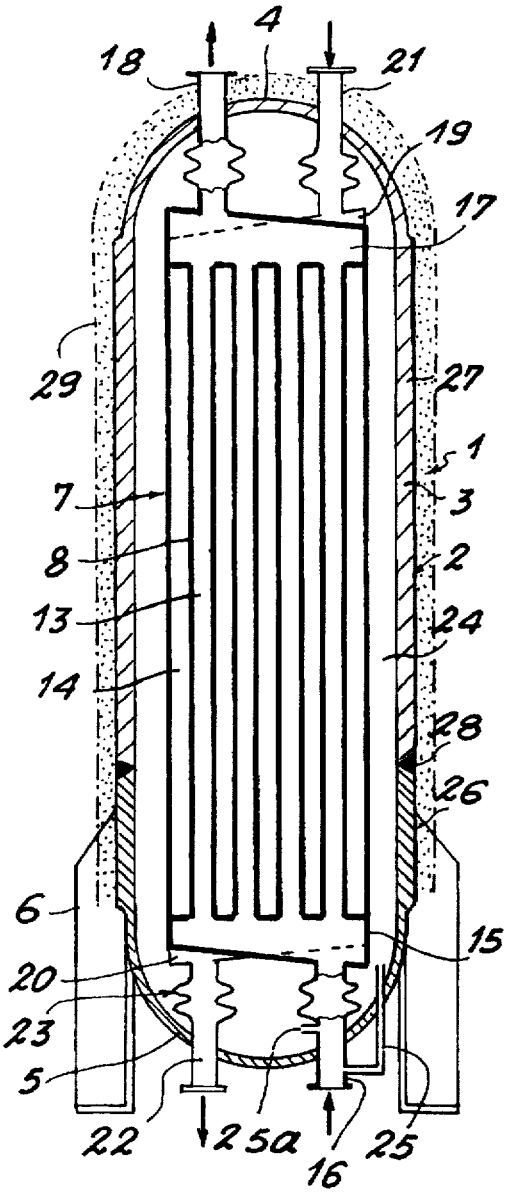
FIG. 1 is a diagrammatical view in vertical cross-section of a conventional welded plate exchanger, in particular of the type used in the refining industry for the operation known by the term "catalytic reforming".

In FIG. 1, reference 1 indicates a welded plate and shell heat exchanger of conventional design, in particular in the petroleum industry, and in particular, though not exclusively, in the refining industry, it being specified at the outset that the invention as described below is not in any way restricted to one particular application or utilisation of such an exchanger.

Exchanger 1 comprises a vertical axis enclosure 2 comprising an appropriate assemblage of a lateral wall which in the example in question is a substantially cylindrical shell 3 and two hemispherical ends, an upper end 4 and a lower end 5 respectively. Enclosure 2 is held in the position shown with its axis vertical by means of feet providing support on the ground, such as 6, which are welded to the lower part of shell 3. As a variant the shell may have a different cross-section, and likewise the ends closing off the shell may have a different shape, the ends having e.g. an elliptical profile.

Within this is housed an exchanger bundle 7 which in the embodiment illustrated more specially comprises a stack of parallel plates such as 8. These plates are preferably formed by explosion, using a method which is in itself known. Preferably they are formed (in a way which is not illustrated in the drawing) to have bosses on either side of the plane of each plate by means of which the plates bear against each other mechanically at a large number of points depending on the thickness of the bundle.

Figure 2:
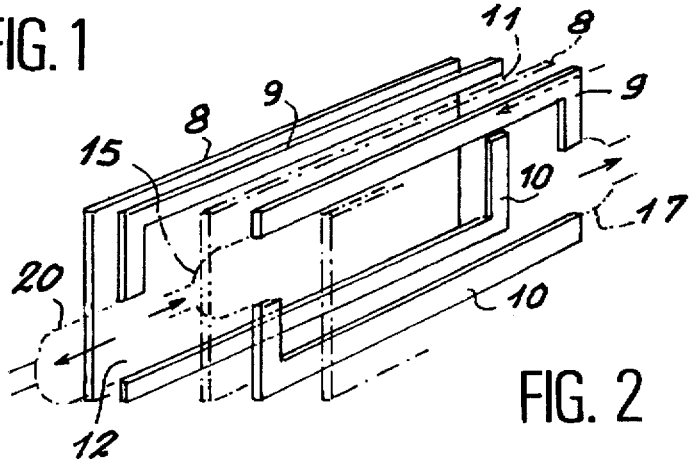
FIG. 2 is a partial perspective view of a part of the plate bundle used in the exchanger according to FIG. 1.

Preferably, as shown diagrammatically in FIG. 2, struts 9 and 10, in the form of L-shaped bars, are placed between the adjacent plates in such a way as to provide two slots 11 and 12, which are opposite each other with the two smaller sides opposite the plates, for each space separating two successive plates in the bundle. Slots 11 and 12 of one space are also offset with respect to those in the two adjacent spaces.

Figure 2A:
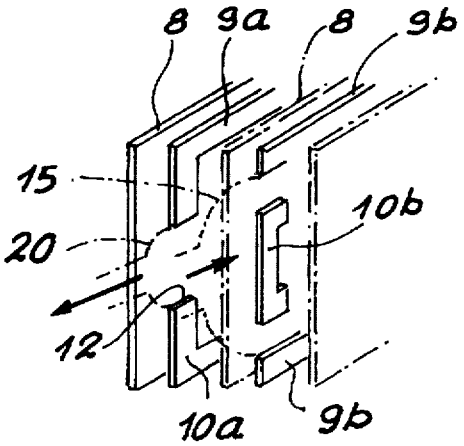
FIG. 2A illustrates a variant embodiment of the plate bundle.

Of course the above arrangement is not in itself exclusive, and plates 8 may be spaced by means of struts of different shape, as illustrated for example in FIG. 2A where the adjacent spaces are alternately equipped with U-shaped struts 9*a* and 10*a* opposite each other, and respectively identical struts 9*b* in the form of longitudinal bars located along the lateral sides of plate 8, these bars being separated by intermediate plates 10*b* which extend perpendicular to the direction of the above.

These arrangements which are in themselves conventional, regardless of the shapes used for the spacing struts, provide adjacent circulation channels between the plates, 13 and 14 respectively (FIG. 1), for the circulation of two fluids which exchange heat between each other across the plates of the bundle stack, one of these fluids being a heating fluid and the other a fluid to be heated, these fluids being in the liquid or gaseous state or again in two phases, depending on the conditions under which the exchanger is operated, the nature of these fluids and the temperatures obtaining. Channels 13 and 14 are alternately juxtaposed in the bundle between successive plates, strut bars 9 and 10 being turned at 180 to each other.

All channels 13 used e.g. for circulation of the heated fluid are connected at one of the ends of bundle 7, mounted vertically within enclosure 2, to an inlet headspace 15, and this headspace is itself connected to a pipe 16 which delivers fluid to the exchanger. At the top of the bundle there is a similar headspace 17 for discharge of the heated fluid via a discharge pipe 18, the direction of circulation of this fluid being shown diagrammatically by the arrows shown at the ends of pipes 16 and 18.

In the same way, all channels 14 are used for circulation of the heating fluid and are connected to an inlet headspace 19 and opposite this to a discharge headspace 20, which are themselves connected to pipes, 21 and 22 respectively, the direction of this circulation being again shown diagrammatically by the arrows shown at the ends of these pipes. The latter, together with pipes 16 and 18, are advantageously fitted with expansion bellows 23 in order to take up dimensional variations with respect to the enclosure formed by shell 3 and ends 4 and 5 as a result of the differences in the temperature of the fluids passing through them, the heating fluid entering headspace 19 at e.g. 500 C and leaving headspace 20 at around 125 C, while the heated fluid enters headspace 15 at 100 C to leave headspace 17 at approximately 480 C.

Pipes 16, 18, 21 and 22 pass through hemispherical ends 4 and 5 and are welded thereto in a leak-tight manner.

Finally and in accordance with a provision which is in itself known, free space 24 between bundle 7 and the inner wall of shell 3 is filled with a fluid which is effectively stagnant, the pressure of this fluid being preferably equal to the higher of the pressures of the heating fluid or the heated fluid. The fluid which thus fills enclosure 2 may be identical to the above or may be of a different nature. In particular, if the heated fluid is a two-phase mixture, the fluid in the enclosure outside the bundle in space 24 may be a gaseous fraction of this mixture.

In the example illustrated in FIG. 1, the fluid present in space 24 corresponds to the heated fluid, at the pressure of the latter when it enters the device via pipe 16, a connecting conduit 25 being provided for this purpose between this pipe and the interior of shell 3 after passing through lower end 5. As a variant, one or more openings such as 25*a*, achieving the desired equalisation of pressure, may be provided directly in pipe 16. Of course if the fluid passed into enclosure 2 is different from the fluid being heated, it is introduced into this enclosure by means of a separate conduit.

In an embodiment of this type exchange bundle 7 radiates heat into space 24 so that the temperature to which shell 3 and ends 4 and 5 is raised increases progressively from the lower part to the upper part of enclosure 2. The temperature rise in the enclosure is also due to the slight convection created, particularly if the fluid in space 24 is not wholly stagnant, and likewise to the lesser but nevertheless not wholly negligible conduction at the places where pipes 16, 18, 21 and 22 pass through ends 4 and 5. Thermal insulation 29 covers upper end 4 and shell 3 to minimise heat losses to the outside environment and to protect personnel. In general, in a manner which is not shown, this insulation also covers lower end 5.

The ends and the lateral shell may not be entirely constructed using a sheet of ordinary steel, in particular a carbon steel, which is suitably shaped and assembled according to the height of the equipment. For example, for fluids which contain a large proportion of hydrogen lower end 5 and the lower part 26 of the shell may be constructed of such an ordinary steel up to a level corresponding to approximately 270 C, but upper part 27 and upper end 4 must be manufactured using in particular chromium-molybdenum alloy steel sheet. This material is more expensive and more difficult to work, in particular more difficult to shape and weld. This increases the cost of the exchanger. In FIG. 1 linking zone 28 between the two parts 26 and 27 of shell 3 is located barely one third of the way up under the conditions of use envisaged.

Figure 1A:
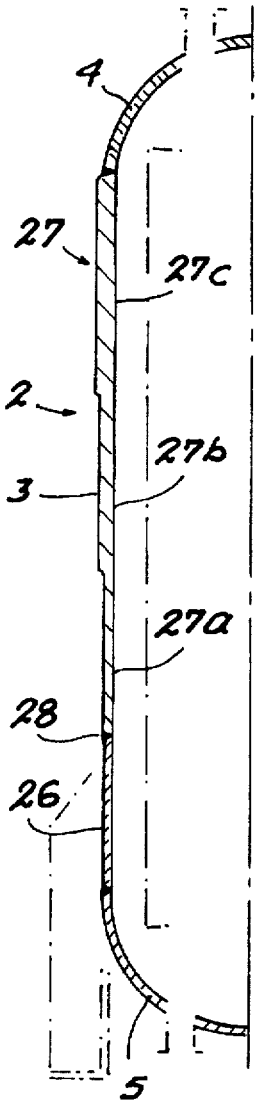
FIG. 1A illustrates a variant of the enclosure of the exchanger according to FIG. 1.

In FIG. 1 the outer wall of the shell is shown with its two successive parts 26 and 27 which have a substantially constant thickness from the top to the bottom of the enclosure between hemispherical ends 4 and 5. It is then necessary to give the steel sheets used a thickness equal to that which is necessary in the part which is raised to the higher temperature. However in practice it may be preferable to give the shell a progressive thickness, in particular in part 27, forming the latter with successive members such as 27*a*, 27*b*, 27*c*, as shown in FIG. 1A, each of which have a different thickness which increases on going up the shell, in relation to the corresponding increase in temperature. Even in this case construction is costly.

Figure 3:
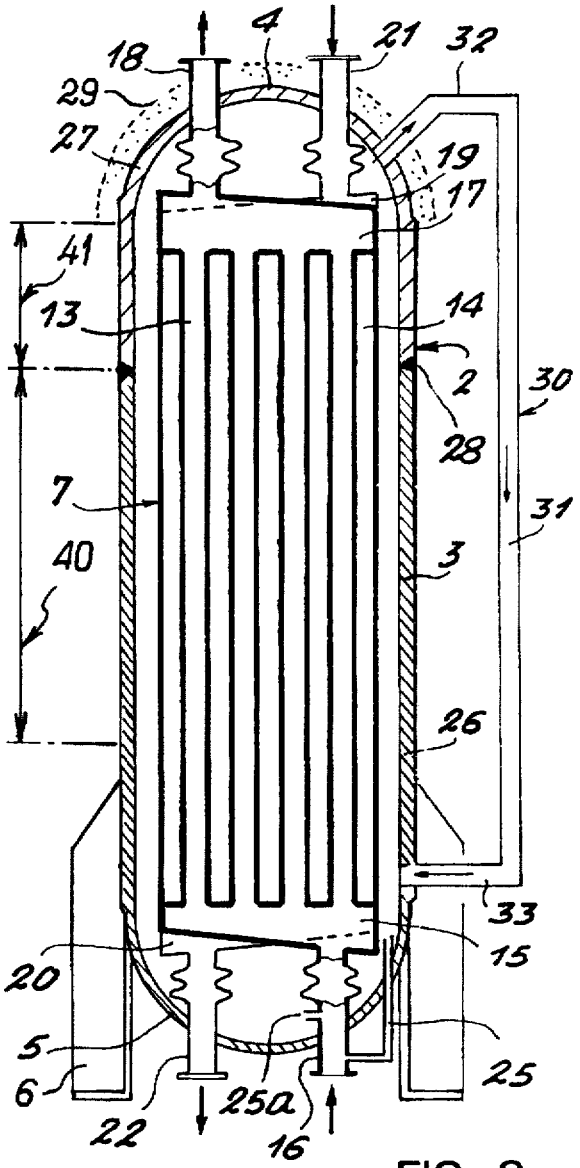
FIG. 3 is a view in vertical cross-section of an exchanger similar to the one in FIG. 1, incorporating means according to the invention.

In order to overcome the disadvantages presented in this way by conventional arrangements, the provisions illustrated in FIG. 3 in particular are used. In this figure identical reference numbers to those in the previous figures have been used to identify the individual members.

In this case enclosure 2 is associated with means whereby the enclosure may be cooled. In the example shown, there are two of these means in combination, but each could be used separately. A first means comprises removing thermal insulation 29 over shell 3 in such a way that shell 3 cools by radiating heat to the exterior. The removal of insulation 29 applies in particular to cold part 26 in a region 40 adjacent to hot part 27, as well as region 41 of the shell which belongs to the hot part. In the example insulation 29 is only maintained over hot end 4, because this in general is a zone which is accessible to personnel and where it would as a consequence be inappropriate to leave exposed walls at a temperature of more than 100 C.

Another means for cooling the enclosure consists in general of providing continuous circulation of the fluid present in space 24 between the bundle and the inside surface of shell 3, in such a way that this fluid can be suitably cooled on the outside to keep the temperature of the shell at a value which is on average substantially less high than in the conventional arrangement.

Figure 3A:
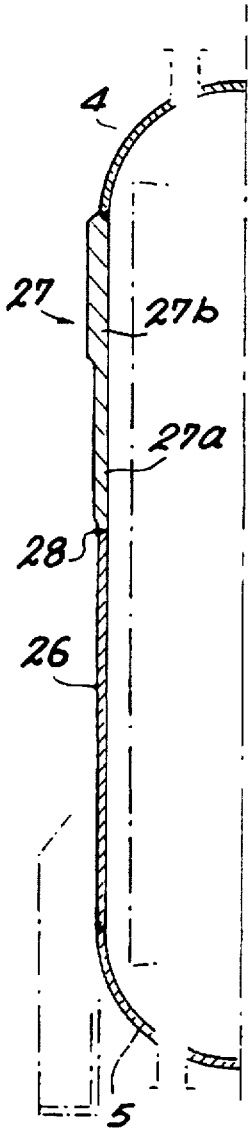
FIG. 3A is a variant of the enclosure of the exchanger corresponding to FIG. 3, substantially as FIG. 1A corresponds to FIG. 1.

As a result the lower part 26 of the shell, which is constructed of carbon steel, may be appreciably larger than part 27 which is of chromium-molybdenum steel. Furthermore the mean thickness of part 27, and consequently the amount of metal used, may also be on the whole smaller. Linking zone 28 between parts 26 and 27 is located much closer to the top of the shell, very close to end 4. FIG. 3A illustrates, in a manner similar to FIG. 1A seen above, an embodiment in which part 27 of the chromium-molybdenum steel shell is formed of graduated members 27*a* and 27*b*, whose thickness increases from one to the next.

In order to achieve continuous circulation of the fluid enclosed in space 24, provision is made according to the invention for associating enclosure 2 with an external circuit 30, comprising at least one conduit 31 of appropriate diameter having connections 32 and 33, which are substantially horizontal and parallel, at its upper and lower ends, which pass through the enclosure on either side of regions 40 and 41 to permit the fluid therein to be drawn off and to circulate downwards in conduit 31 respectively before being returned to the enclosure. Conduit 31 extends vertically, being located in the surrounding ambient atmosphere. The aforesaid circulation takes place as a result of natural thermosyphon because of the differences in temperature in the fluid in the upper and lower parts into which connections 32 and 33 open.

Along its path this fluid exchanges heat with the outside atmosphere in an amount such that it can absorb an adjustable proportion of the amount of heat emitted in the enclosure by bundle 7 towards shell 3. Circulation of the fluid is brought about by the static pressure difference generated by the differences in the mean density of this fluid between the inside and the outside, balancing the losses of head brought about by this circulation.

Figure 4:
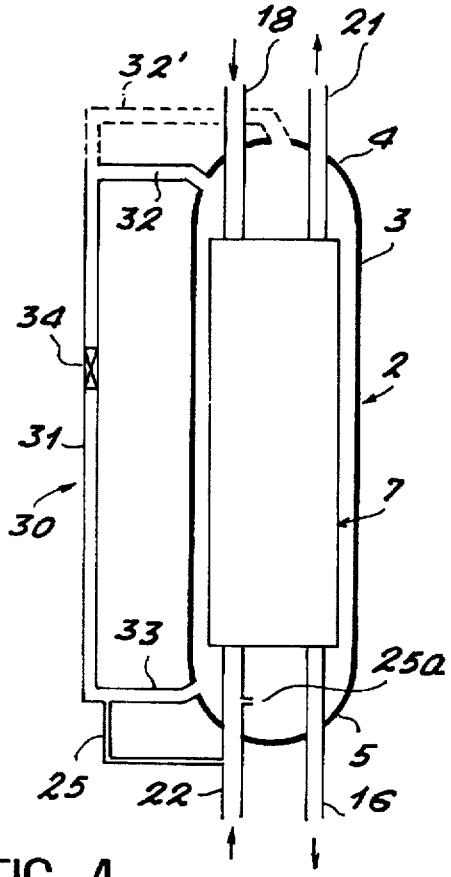
FIGS. 4, 5 and 6 are even more diagrammatical views in cross-section of a number of variant embodiments of the exchanger according to FIG. 3.
Figure 5:
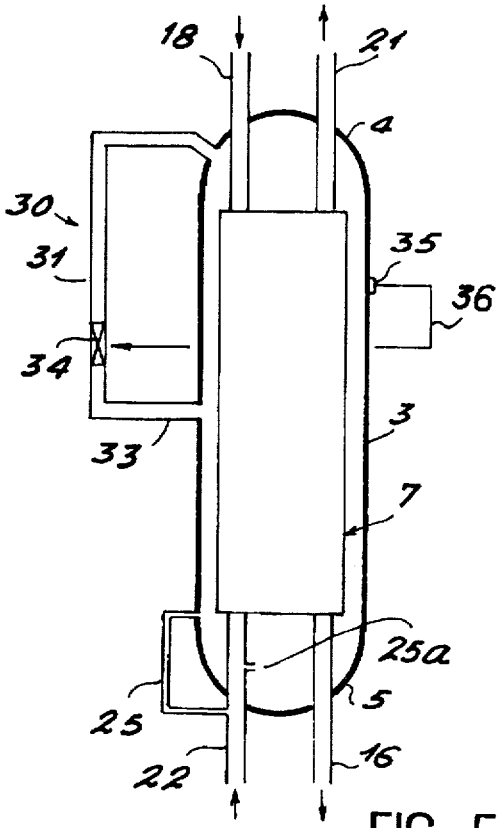

The desired cooling effect is essential in the middle and upper parts of the shell where the temperature is highest, which means that the region of the enclosure where horizontal connection 32 passes through the latter has to be determined in an optimum way. Thus as shown in FIG. 4, connection 32 may in practice be located at the highest point on the cylindrical shell, or again open into the upper end as shown by reference 32'. Likewise, connection 33 through which the fluid returns to the interior of the enclosure may be located in the bottom part of shell 3 (FIG. 4), or at any other location and in particular in its middle portion (FIG. 5).

In particular, when conduit 31 is used in combination with the at least partial removal of insulation 29 it will be seen that the circulation through conduit 31 provides supplementary adjustable cooling for the enclosure, in order to stabilise the latter under specific temperature conditions, despite in particular the changes in climatic conditions to which the uninsulated outer surface of the shell is exposed. Thus, advantageously, but not necessarily in all circumstances of use, vertical conduit 31 may be provided with an electrical valve 34 which may be used to adjust if necessary the flow of fluid in this conduit. Furthermore, this electrical valve 34 may advantageously be controlled by the output provided by one or more temperature sensors 35 (FIG. 5) which measure the temperature of the outside surface of shell 3 and which are connected by appropriate connections 36 to the servomotor of the corresponding electrical valve. In a simplified version, knowing the temperatures of the enclosure at different levels on the shell may be used to operate one or more manual control valves.

Figure 6:
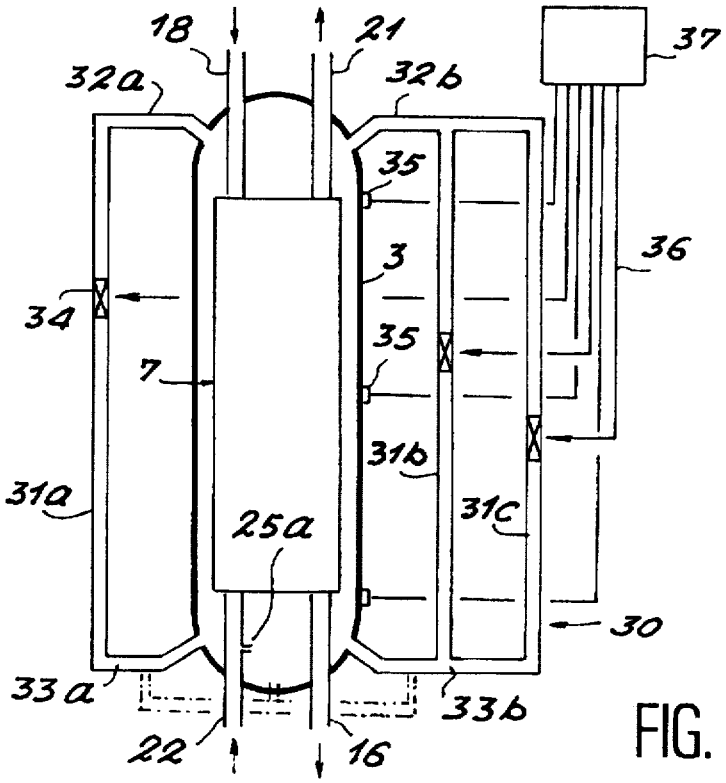

In another variant illustrated in FIG. 6, circuit 30 through which the fluid in the enclosure circulates may incorporate a plurality of conduits 31*a*, 31*b*, 31*c*, which are connected to the enclosure by connections 32*a* and 33*a* for conduit 31*a*, or again by 32*b* and 33*b* for conduits 31*b* and 31*c*, the later then being mounted in parallel with each other. All or some of these conduits may incorporate electrical valves 34, sensors 35 distributed over the height of the shell, and may be connected by their connections 36 to a control unit 37 which adjusts the relative flows of fluid in these various conduits and in particular makes it possible to subject the mean temperature of the shell to the results of the measurements made.

Of course the invention is not restricted to the embodiments more specially described with reference to the appended drawings. On the contrary it encompasses all variants. In particular, the special structure of the heat exchange bundle does not in itself govern implementation of the invention as described in connection with the description of FIGS. 2 and 2A. Likewise the result achieved may be improved by measures applied to the opposing surfaces of the plate bundle and the shell, in particular in order to provide them with a surface condition which will further limit the thermal radiation effect between the bundle and the shell, consequently reducing the increase in the shell temperature. Likewise, the fluid present in space 24 between the shell and the bundle may be selected so as to have characteristics which permit better absorption by it of the heat radiated by the bundle.

In all circumstances the thermosyphon effect set up in the circuit outside the shell and the circulation by natural thermosyphon of the fluid which fills the space between the exchanger bundle and the external enclosure provide sufficient cooling of the latter With a balanced loss of head. By way of indication, with a shell having a diameter of the order of 2 m and a height of around 13 m, the external circuit has a length of approximately 17 m for an outside conduit diameter of 114 mm, where the temperature gradient, as already mentioned, extends from 100 to 500 C, the loss of head generated with a circulating flow of fluid representing around 100 kg/h, being not greater than 10 Pa, the latter value being by definition covered by the pressure difference created by the difference in the density of the fluid between the interior of the enclosure and the interior of the conduit in the external circuit. With these data a significant fall in the shell temperature, which may be 100 C or more, is achieved without significantly affecting heat transfer between the two fluids, the ratio of the amount of heat removed by the thermosyphon to that exchanged in the device being in the above example of the order of one to one thousand. Removal of the insulation at least over part of the height of the shell also brings about a significant reduction in the temperature of the shell. Thus in a specific example, combining thermosyphon with the removal of insulation has made it possible to reduce the temperature at the top of the shell from 490 C to around 300 C, in which case the shell can be constructed of cheap carbon steel to almost its full height.

The invention can be applied to exchangers which are mounted e.g. horizontally. Even in this situation circulation by thermosyphon may be achieved by connecting the outer conduit to two different levels on the enclosure. Circulation by thermosyphon can be achieved even if the hot end of the exchanger is at the bottom, in particular as there is a difference in mean temperature between the fluid within the enclosure and the fluid in the outside conduit. Circulation may also be brought about, wholly or in combination with the thermosyphon effect, by means of a pump.

We claim:

1. Heat exchange means comprising a heat exchange bundle (7) which provides two separate paths in opposite directions for two exchange fluids and an enclosure (2) which contains the bundle and whose inner surface is exposed to thermal radiation originating from the bundle, through an intermediate space located between the inner surface of the enclosure (2) and the bundle (14), the enclosure (2) comprising a lateral wall (3) closed off by a hot end (4) on the side on which the heating fluid enters and the heated fluid leaves, and a cold end (5) opposite the hot end, characterised in that the enclosure is constructed in two parts, a cold part (26) including the cold end (5) and at least the greater part of the lateral wall (3), and a hot part (27) including the hot end (4) and constructed of a material having a better resistance to heat than the cold part, and in that the means (1) comprises means (31) to remove heat from the enclosure at least in a region (40) of the cold part (26) of the enclosure which is adjacent to the hot part (27).

2. Means according to claim 1, characterised by thermal insulation (29) over a particular surface area from the hot end of the enclosure (2).

3. Means according to claim 1, characterised in that as means for removing heat, the outer surface of the said adjacent region (40) is directly exposed to the outside environment.

4. Means according to claim 1, characterised in that the enclosure (2) encloses a fluid in the said intermediate space located between the inner surface of the enclosure (2) and the bundle (14), and in that the means for removing heat comprise means (30) for circulating the fluid in the intermediate space in a closed circuit comprising the intermediate space (24) and at least one conduit (31) which exchanges heat with the outside environment and connects two separate points (32, 33) on the enclosure located on either side of the said adjacent region (40).

5. Means according to claim 4, characterised in that the means for circulating the fluid in the closed circuit comprise, relative to the operating condition of the means, a vertical space between the two aforesaid separate points (32, 33) on the enclosure in such a way as to create conditions for establishing circulation by thermosyphon.

6. Means according to claim 4, characterised in that one of the ends (32) of the outer conduit (31) is connected to another part of the lateral wall (3) of the enclosure (2), or the upper end of the enclosure, the other end (33) being connected to a lower part of the said lateral wall or an intermediate region thereof.

7. Means according to claim 4, chacterised in that the closed circuit comprises a plurality of external conduits (31*a*, 31*b*, 31*c*, . . . ), mounted in parallel on the enclosure.

8. Means according to claim 7, characterised in that the closed circuit (30) comprises a conduit (32) for withdrawing fluid from the enclosure and a conduit (33) for returning to fluid to the enclosure, these two conduits extending horizontally, parallel to each other, and being connected by separate connecting pipes (31) which are arranged vertically and through which the fluid passes outside the enclosure.

9. Means according to claim 4, characterised in that the diameter of the conduits (31, 32, 33) in the circuit (30) is such as to ensure equilibrium of the thermosyphon set up in the circuit.

10. Means according to claim 4, characterised by means (34) for controlling the flow in the conduit (31).

11. Means according to claim 10, characterised in that the means for controlling the flow is of the thermostatic type controlled from at least one sensor (35) for the temperature of the enclosure (2).

12. Means according to claim 4, characterised in that the enclosure (2) comprises, carefully distributed over its height, temperature sensors (35) whose readings can be used for manual adjustment or adjustment via an electronic control device of the opening or closing setting of at least one valve (34) mounted on the outside conduit (31) to adjust the flow of fluid circulating in the circuit (30).

13. Means according to claim 7, characterised in that the enclosure (2) comprises, carefully distributed over its height, temperature sensors (35) whose readings can be used for adjustment, manually or via an electronic control device, of the opening or closing setting of valves located in the outside conduits (31*a*, 31*b*, 31*c*) to adjust the flow of fluid circulating in the circuit (30).

14. Means according to claim 1, in which the opposing surfaces of the bundle (7) and the lateral wall (3) are surface treated so as to adjust heat exchanges by radiation between the bundle and the lateral wall.

15. Means according to claim 1, in which the fluid in the intermediate space (24) between the bundle and the lateral wall is selected so as to permit improved absorption of the heat radiated by the bundle.

16. Means according to claim 1, characterised in that the bundle (7) for exchange is mounted vertically within the enclosure.

17. Heat exchanger comprising a means according to claim 1.

18. A method for cooling a lateral wall (3) of a shaped metal enclosure (2), this lateral wall being closed off at each end by an end (4, 5) and containing a bundle (7) for exchange between two fluids, a heating fluid and a heated fluid respectively, which pass through the bundle, this being mounted vertically in the enclosure and radiating heat towards the inner surface of the lateral wall in an intermediate space (24) provided between the latter and the bundle and filled with a fluid which is identical to or different from one of the two fluids passing through this bundle, characterised in that the method comprises the step of circulating the fluid present in the intermediate space through a closed circuit (30) which comprises the said intermediate space and at least one conduit (31) outside the enclosure connected to two separate points thereon.

19. A method according to claim 18, characterised in that the fluid present in the intermediate space (24) is caused to circulate by a natural thermal syphoning effect by placing the two aforesaid separate points at two different heights along the enclosure.

20. A method according to claim 18, characterised in that the fluid circulating in the closed circuit (30) is subjected to a pressure equal to that of the higher of the pressures of the heating and heated fluids.

21. A method according to claim 18, characterised in that a two-phase mixture is used as the heated fluid and gas separated from the said mixture is circulated in the closed circuit.

22. A method according to claim 18, characterised in that at least one valve (34) installed in the conduit (31, 31*a*) is regulated.

23. A method according to claim 22, characterised in that the temperature is monitored at at least one point on the enclosure and that the valve (34) is adjusted so as to increase the flow in the conduit (31) in relation to the temperature detected.

24. A method according to claim 18, characterized in that said heating fluid and said heated fluid are passed through the bundle in a counter-current fashion.

* * * * *